US010044150B2

(12) United States Patent
Zieman et al.

(10) Patent No.: US 10,044,150 B2
(45) Date of Patent: Aug. 7, 2018

(54) MULTIPORT RADIO FREQUENCY CONNECTOR ISOLATION

(71) Applicant: Cisco Technology, Inc., San Jose, CA (US)

(72) Inventors: Christopher Eugene Zieman, Chapel Hill, NC (US); Denis Gerard Downey, Pleasanton, CA (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 15/458,963

(22) Filed: Mar. 14, 2017

(65) Prior Publication Data

US 2017/0187149 A1 Jun. 29, 2017

Related U.S. Application Data

(63) Continuation of application No. 14/595,430, filed on Jan. 13, 2015, now Pat. No. 9,620,908.

(51) Int. Cl.

| | |
|---|---|
| ***H01R 13/6588*** | (2011.01) |
| ***H01R 13/6598*** | (2011.01) |
| ***H01R 13/639*** | (2006.01) |
| ***H01R 13/629*** | (2006.01) |
| ***H01R 13/659*** | (2011.01) |
| ***H01R 13/6585*** | (2011.01) |

(52) U.S. Cl.

CPC ..... *H01R 13/6588* (2013.01); *H01R 13/629* (2013.01); *H01R 13/639* (2013.01); *H01R 13/659* (2013.01); *H01R 13/6585* (2013.01); *H01R 13/6598* (2013.01)

(58) Field of Classification Search

CPC ..... H01R 13/6585; H01R 13/659

See application file for complete search history.

(56) References Cited

U.S. PATENT DOCUMENTS 4,872,846 A * 10/1989 Clark ..... H01R 4/02 439/83

7,632,112 B2 * 12/2009 Wakamatsu ..... H01R 4/028 428/672

(Continued)

*Primary Examiner* — James Harvey

(74) *Attorney, Agent, or Firm* — Ronald S. Fernando

(57) ABSTRACT

Previously available elastomeric EMI gaskets provided for multiport RF connector assemblies have performance limiting drawbacks. Consequently, EM isolation provided by a previously available elastomeric EMI gasket is often inadequate. Various implementations disclosed herein include multiport RF connection arrangements that use a metal gasket arranged within at least a portion of an isolation space provided by a multiport RF connector. In some implementations, a multiport connection arrangement includes a substrate, a multiport RF connector and a fitted metal gasket. The substrate includes a first surface and a first plurality of connection ports. The multiport connector has a body that includes a second surface, a second plurality of connection ports, and includes an electromagnetic isolation boundary that defines an isolation space between at least two of the second plurality of connection ports terminating at the second surface. Mechanical fasteners are optional and are included to merely provide engagement, without substantial compressive force.

20 Claims, 8 Drawing Sheets

(56) References Cited

U.S. PATENT DOCUMENTS

| | | | | |
|---|---|---|---|---|
| 8,608,496 | B2 * | 12/2013 | Shenouda | H01R 9/031 174/72 B |
| 9,620,908 | B2 * | 4/2017 | Zieman | H01R 13/6585 |
| 2003/0040218 | A1 * | 2/2003 | Gollhofer | H05K 3/306 439/567 |
| 2009/0091908 | A1 | 4/2009 | Clavier et al. | |
| 2011/0306240 | A1 | 12/2011 | Chow et al. | |
| 2012/0164856 | A1 * | 6/2012 | Okuyama | H01R 43/0235 439/83 |
| 2013/0267118 | A1 | 10/2013 | Cai | |
| 2014/0322974 | A1 * | 10/2014 | Chang | H01R 13/6585 439/607.01 |
| 2016/0204553 | A1 | 7/2016 | Zieman et al. | |
| 2017/0187149 | A1 * | 6/2017 | Zieman | H01R 13/6588 |

* cited by examiner

MULTIPORT RADIO FREQUENCY CONNECTOR ISOLATION

CROSS-REFERENCE TO RELATED APPLICATIONS

This application claims priority to U.S. patent application Ser. No. 14/595,430, filed on Jan. 13, 2015, which is hereby incorporated by reference in its entirety.

TECHNICAL FIELD

The present disclosure relates to multiport radio frequency (RF) connectors, and in particular, to enabling sufficient port-to-port electromagnetic isolation between ports.

BACKGROUND

The ongoing development of data networks often involves incorporating additional functionality into and enabling greater connectivity with a network node. This end can be pursued in part by increasing the number of ports included in a network node. As the number of ports increases, it is useful to group ports in order to produce a physically manageable interface, with relatively compact form-factors.

One way to group ports is through a multiport RF connector. A multiport RF connector includes an array of ports housed in a machined or cast body. Electromagnetic interference (EMI) between ports can increase errors in data flows routed through the ports. Previous solutions rely on port spacing and ground pins in order to limit EMI. As multiport RF connectors become denser, port-to-port EM isolation becomes more difficult to achieve.

One of the more challenging areas to provide sufficient isolation is at the interface between a multiport connector and the plane of a printed circuit board (PCB). Grounds pins alone cannot be relied on to provide sufficient EM isolation between densely packed ports. In previous solutions, an elastomeric EMI gasket is arranged between a multiport RF connector and the PCB plane in order to improve EM isolation. But, elastomeric EMI gaskets have a number of performance limiting drawbacks. For example, a typical elastomeric EMI gasket has a limited lifespan, in part, because elastomeric materials are often sensitive to heat and are degraded by compressive forces used to hold a gasket in place. Moreover, elastomeric EMI gaskets are typically made conductive by the inclusion of a metal fill suspended in the elastomeric material. Compressive forces change the effective density of metal filled elastomeric EMI gaskets, and the magnitude of compressive forces used tend to cause a PCB bow, which degrades EM isolation. Also, as port density increases, there is less room for compression set screws, which results the PCB having a slight waviness between the compression set screws.

BRIEF DESCRIPTION OF THE DRAWINGS

So that the present disclosure can be understood by those of ordinary skill in the art, a more detailed description may be had by reference to aspects of some illustrative implementations, some of which are shown in the accompanying drawings.

Figure 1:
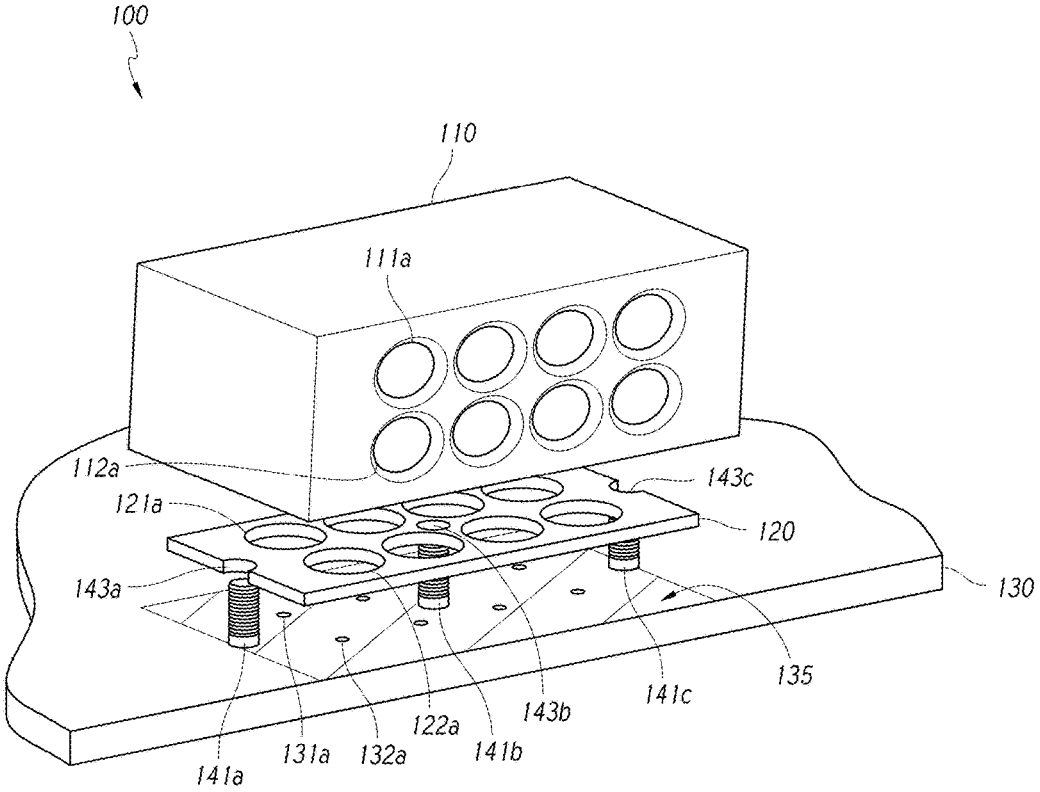
FIG. 1 is an exploded view of a multiport connection assembly.

In accordance with common practice various features shown in the drawings may not be drawn to scale, as the dimensions of various features may be arbitrarily expanded or reduced for clarity. Moreover, the drawings may not depict all of the aspects and/or variants of a given system, method or apparatus admitted by the specification. Finally, like reference numerals are used to denote like features throughout the figures.

DESCRIPTION

Numerous details are described herein in order to provide a thorough understanding of illustrative implementations shown in the drawings. However, the drawings merely show some example aspects of the present disclosure and are therefore not to be considered limiting. Those of ordinary skill in the art will appreciate from the present disclosure that other effective aspects and/or variants do not include all of the specific details described herein. Moreover, well-known systems, methods, components, devices and circuits have not been described in exhaustive detail so as not to unnecessarily obscure more pertinent aspects of the implementations described herein.

Overview

Previously available elastomeric (i.e., elastomer-based) EMI gaskets provided for multiport RF connectors and assemblies typically have performance limiting drawbacks. For example, a typical elastomeric EMI gasket has a limited lifespan, and the compressive forces used to hold an elastomeric EMI gasket in place tend to cause deformation of a PCB. Consequently, EM isolation provided by a previously available elastomeric EMI gasket is often inadequate. By contrast, various implementations disclosed herein include multiport RF connection arrangements that use a metal gasket arranged within at least a portion of an isolation space provided by a multiport RF connector. Mechanical fasteners are optional and are included to merely provide engagement, without substantial compressive force. The magnitude of the compressive force(s) imparted by the fastener(s) is below a threshold level characterizing the compressive force needed to cause substantial deformation of a PCB. In some implementations, a multiport connection arrangement includes a substrate, a multiport RF connector and a fitted metal gasket. The substrate includes a first surface and a first plurality of connection ports. The multiport connector has a body and includes a second surface, a second plurality of connection ports, and includes an electromagnetic isolation boundary that defines an isolation space along the second surface and between at least two of the second plurality of connection ports that terminate proximate to the second surface.

FIG. 1 is an exploded view of a multiport connection assembly 100. The multiport connection assembly 100 includes a multiport RF connector 110, an elastomeric EMI gasket 120 and a PCB substrate 130. As an example, the multiport RF connector 110 includes two rows of ports, with each port extending into and routed through the body of the multiport RF connector 110 (shown in FIG. 2). For example, the first row includes port 111*a*, and the second row includes port 112*a*. Similarly, the PCB substrate 130 includes two rows of connection ports, along first surface 135, corresponding to the two rows of ports of the multiport RF connector 110. For example, the first row includes connection port 131*a*, and the second row includes connection port 132*a*. The elastomeric EMI gasket 120 is arranged between the multiport RF connector 110 and the PCB substrate 130. Similar to the multiport RF connector 110 and the PCB substrate 130, the elastomeric EMI gasket 120 also includes two rows of apertures that enable mating of the ports of the multiport RF connector 110 and the PCB substrate 130. For example, a first row of apertures includes aperture 121*a*, and the second row of apertures includes aperture 122*a*. The elastomeric EMI gasket 120 also includes apertures 143*a*, 143*b*, 143*c* for corresponding compression set screws 141*a*, 141*b*, 141*c*. In particular, in accordance with previously available solutions the compression set screws 141*a*, 141*b*, 141*c* are used to compress the elastomeric EMI gasket 120 between multiport RF connector 110 and the PCB substrate 130.

Figure 2:
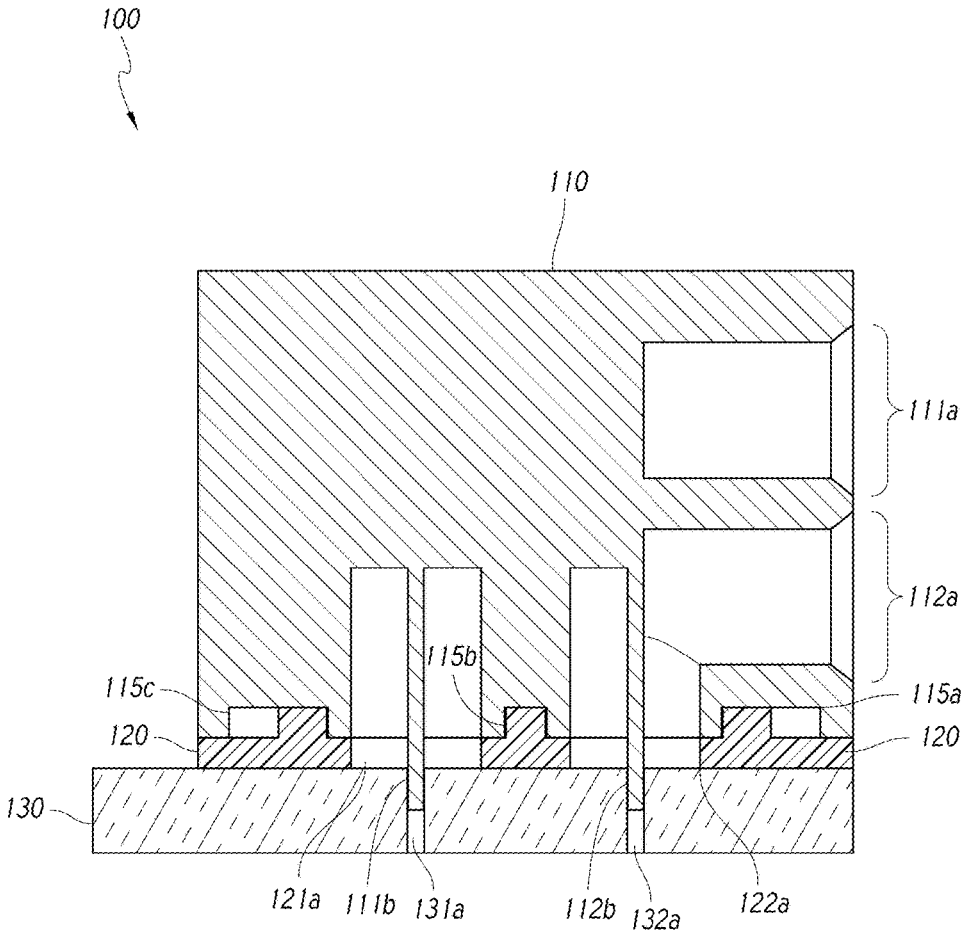
FIG. 2 is a cross-sectional view of a portion of the multiport connection assembly of FIG. 1.

With continued reference to FIG. 1, FIG. 2 is a cross-sectional view that shows the elastomeric EMI gasket 120 compressed between multiport RF connector 110 and the PCB substrate 130. As shown in FIG. 2, each port of the multiport RF connector 110 includes a respective conductive pin that mates with a respective connection port in the PCB substrate 130. For example, conductive pin 111*b* of the port 111*a* mates with the connection port 131*a*, and conductive pin 112*b* of the port 112*a* mates with the connection port 132*a*.

The multiport RF connector 110 includes compression wells 115*a*, 115*b*, 115*c* where the connector 110 meets the elastomeric EMI gasket 120. Once compressed, the elastomeric EMI gasket 120 typically only partially fills the compression wells 115*a*, 115*b*, 115*c* (as shown for example with compression wells 115*a* and 115*c*), which in turn provides a flawed barrier between ports. As the port density increases and the space between ports is reduced, the amount of elastomeric EMI gasket material between any two ports is also reduced. Little elastomeric EMI gasket material, if any, will enter a compression well as the well openings get smaller, which is due to the surface tension properties of the elastomeric EMI gasket material. It also becomes difficult to control the compression rate and the pressure the gasket 120 is exerting on the PCB substrate 130. In turn, the PCB substrate 130 can warp between the compression set screws, which creates deformation gaps. As a result, the elastomeric EMI gasket material cannot be relied on to provide an adequate EMI barrier between ports.

Figure 3:
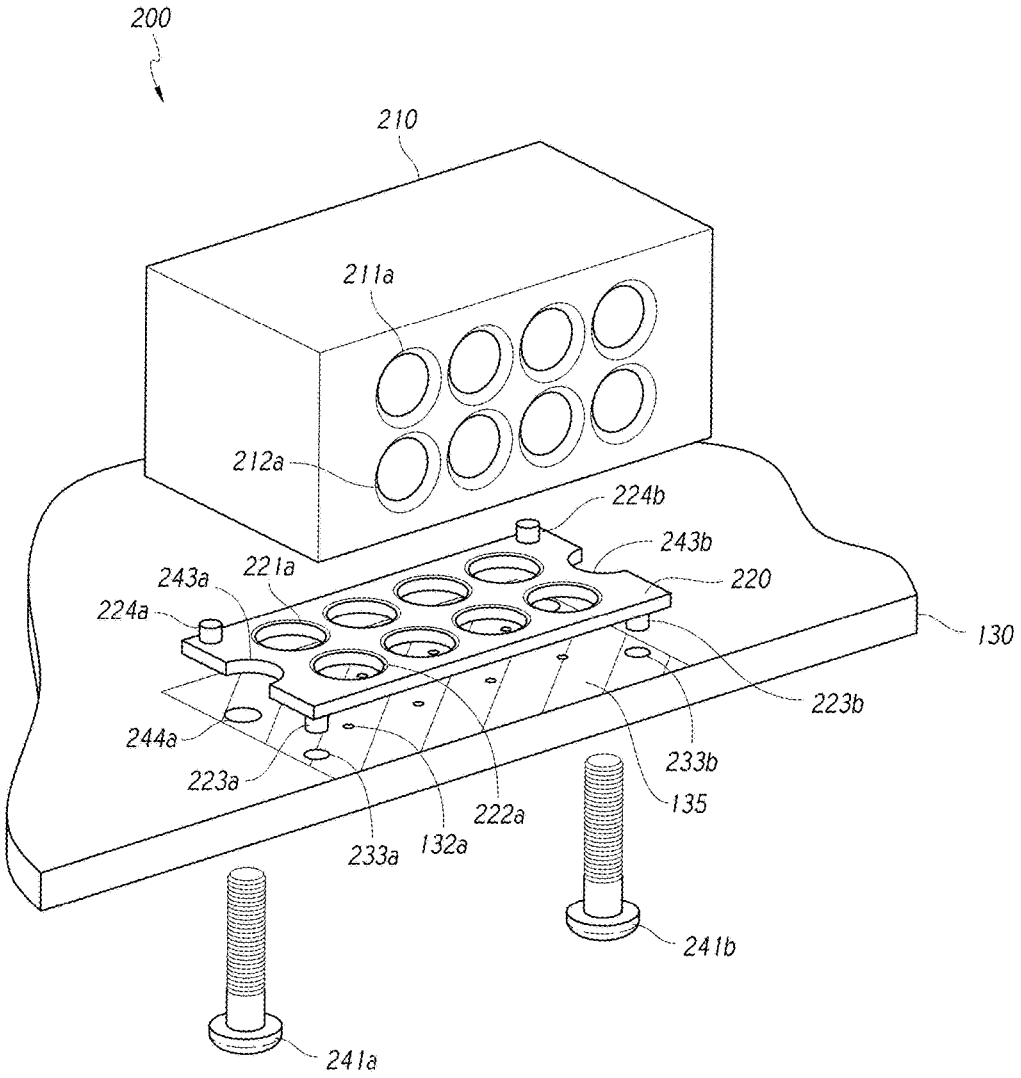
FIG. 3 is an exploded view of a multiport connection assembly according to some implementations.

By contrast, the various implementations described herein include a multiport connection assembly that reduces the problems associated with elastomeric EMI gaskets, by configuring a multiport connector to include an isolation space with which a metal gasket is matched. To that end, FIG. 3 is an exploded view of a multiport connection assembly 200 according to some implementations. While pertinent features are illustrated, those skilled in the art will appreciate from the present disclosure that various other features have not been illustrated for the sake of brevity and so as not to obscure more pertinent aspects of the disclosed example implementations. As an example, the multiport connection assembly 200 includes a multiport RF connector 210, a metal gasket 220 and a PCB substrate 130.

While a PCB substrate is shown as an example, those of ordinary skill in the art will appreciate that various other implementations include any number of packaging and mounting substrates. In some implementations, the substrate includes at least one of a printed circuit board, a backplane and a port mounting plate. Moreover, those of ordinary skill in the art will also appreciate that conductive traces typically included on a PCB have not been illustrated for the sake of clarity and brevity. The PCB substrate 130 includes two rows of connection ports corresponding to the two rows of ports of the multiport RF connector 210. For example, the first row includes connection port 131*a*, and the second row includes connection port 132*a*. While the PCB substrate 130 is illustrated having a total of eight ports, those of ordinary skill in the art will appreciate that, in various implementations, a PCB substrate includes any number of ports arranged in one or more rows.

In some implementations, the PCB substrate 130 also includes mounting holes 244*a*, 244*b* provided for optional mechanical fasteners 241*a*, 241*b*. The optional mechanical fasteners 241*a*, 241*b* are provided to support mechanical engagement of the multiport connection assembly 200, preferably without imparting substantial compressive force. In some implementations, the mechanical fasteners 241*a*, 241*b* support mechanical engagement by providing a compressive force below a threshold level characterizing compressive force causing substantial deformation of the PCB substrate 130. In some implementations, the mechanical fasteners 241*a*, 241*b* include at least one of a press-fit tab, a press-fit post, a barb, a screw, a spring, a nail, a staple and a rivet.

Similar to the PCB substrate 130, the multiport RF connector 210 also includes two rows of ports, with each port extending into and routed through the body of the multiport RF connector 210. For example, the first row includes port 211*a*, and the second row includes port 212*a*. While the multiport RF connector 210 is illustrated having a total of eight ports, those of ordinary skill in the art will appreciate that, in various implementations, a multiport RF connector includes any number of ports.

Figure 4:
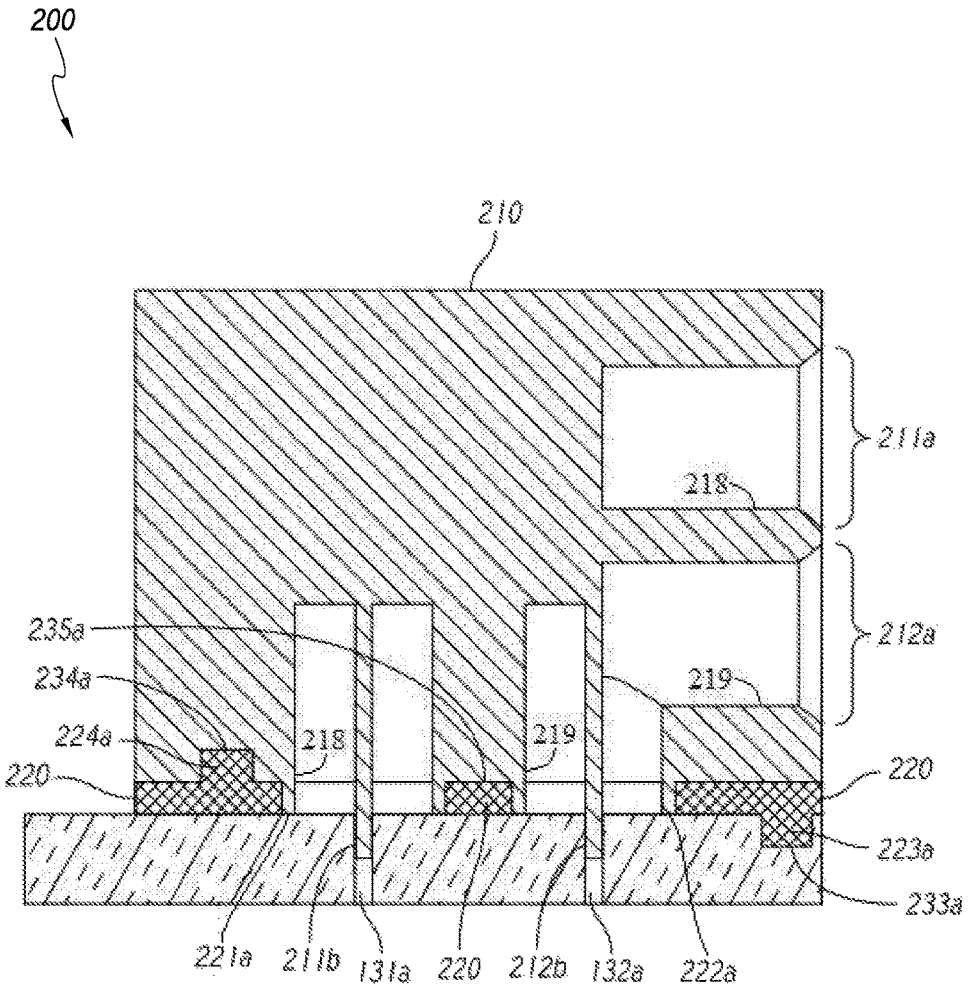
FIG. 4 is a cross-sectional view of a portion of the multiport connection assembly of FIG. 3.
Figure 5:
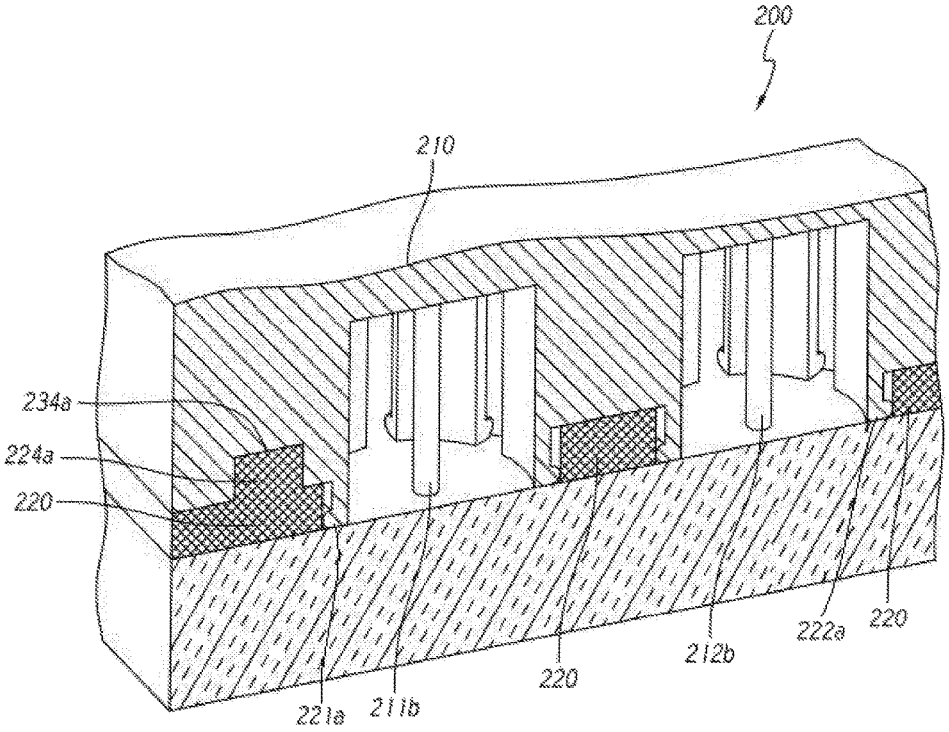
FIG. 5 is a perspective view of a portion of the multiport connection assembly of FIGS. 3 and 4.

With continued reference to FIG. 3, FIG. 4 is a cross-sectional view that shows the metal gasket 220 fitted between multiport RF connector 210 and the PCB substrate 130. FIG. 5 is a perspective view of a portion of the cross-sectional view of FIG. 4. As shown in FIGS. 4 and 5, each port of the multiport RF connector 210 includes a respective conductive pin that mates with a respective connection port in the PCB substrate 130. For example, conductive pin 211*b* of the port 211*a* mates with the connection port 131*a*, and conductive pin 212*b* of the port 212*a* mates with the connection port 132*a*. In other words, at least some of the PCB connection port (i.e., first connection ports) include respective pin mating receptacles arranged to receive respective conductive pins from the ports of the multiport RF connector 210, the pin mating receptacles defined by sidewalls that extend from the surface 135 into the PCB substrate 130. Alternatively, in some implementations, the PCB substrate includes connection ports that include respective conductive pins that respectively extend into the ports of the multiport RF connector 210 (not shown).

The body of the multiport RF connector 210 includes an electromagnetic isolation boundary characterizing an isolation space between at least two of the connection ports (e.g., port 211*a* and port 212*a*) that terminate proximate to the surface of the multiport RF connector 210 that is mated with surface 135 of the PCB 130. As shown in FIGS. 4 and 5, in some implementations, the electromagnetic isolation boundary includes extensions of one or more of the respective sidewalls 218, 219 of at least one of the connection ports 211*a*, 212*a*, each of the respective extensions protruding from the mass of the body and configured to engage a corresponding sidewall-defined aperture (e.g., 221*a*, 222*a*) in the metal gasket 220. In some implementations, the electromagnetic isolation boundary includes a trench into the body of the multiport RF connector 210, and the metal gasket 220 includes a ridge that fits into the trench.

The metal gasket 220 is arranged between multiport RF connector 210 and the surface 135 of the PCB substrate 130. In some implementations, the metal gasket 220 includes sidewall-defined apertures arranged to enable respective mating of at least some of the connection ports of the multiport RF connector 210 with at least some of the connection ports of the PCB substrate 130. In some implementations, the metal gasket 220 is coupled to electrical ground in order to support EM isolation between ports. In some implementations, the metal gasket 220 is one of soldered and epoxied to the surface 135 of the PCB substrate 130 and/or the multiport RF connector 210. Additionally, in some implementations, the metal gasket 220 optionally includes one or more alignment anchors 223*a*, 224*a* arranged to fit into one or more respective alignment wells 233*a*, 234*a* included on one of the PCB substrate and the multiport RF connector 210.

Figure 6:
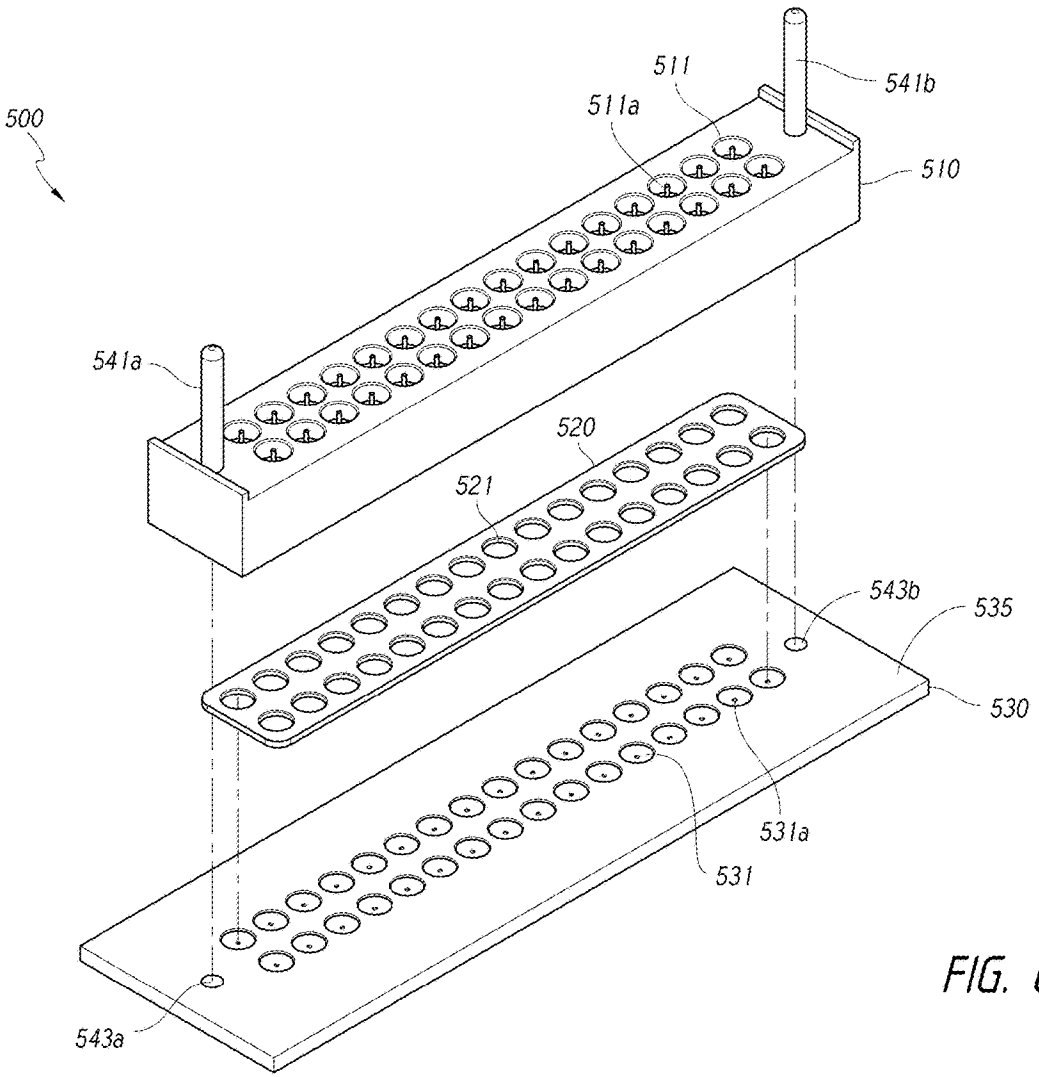
FIG. 6 is an exploded view of another multiport connection assembly according to some implementations.

FIG. 6 is an exploded view of another multiport connection assembly 500 according to some implementations. While pertinent features are illustrated, those skilled in the art will appreciate from the present disclosure that various other features have not been illustrated for the sake of brevity and so as not to obscure more pertinent aspects of the disclosed example implementations. As an example, the multiport connection assembly 500 includes a multiport RF connector 510, a metal gasket 520 and a mounting plate 530.

While a mounting plate is shown as an example, those of ordinary skill in the art will appreciate that various other implementations include any number of packaging and mounting substrates. The mounting plate 530 includes two rows of connection ports along a first surface 535. For example, connection port 531 is labelled in FIG. 6. Each connection port includes a respective pin mating receptacle 531*a*, which is defined by a sidewall that extends into the mounting plate 530. While the mounting plate 530 is illustrated having a total of thirty-two ports, those of ordinary skill in the art will appreciate that, in various implementations, a mounting plate or PCB substrate (or the like) includes any number of ports arranged in one or more rows.

The mounting plate 530 also includes mounting holes 543*a*, 543*b* provided for optional mechanical fasteners 541*a*, 541*b*. The optional mechanical fasteners 541*a*, 541*b* are provided to support mechanical engagement of the multiport connection assembly 500, preferably without imparting substantial compressive force. In some implementations, the mechanical fasteners 541*a*, 541*b* support mechanical engagement by providing a compressive force below a threshold level characterizing compressive force causing substantial deformation of the mounting plate 530. In some implementations, the mechanical fasteners 541*a*, 541*b* include at least one of a press-fit tab, a press-fit post, a barb, a screw, a spring, a nail, a staple and a rivet.

The multiport RF connector 510 also includes two rows of ports, with each port extending through the body of the multiport RF connector 510. For example, connection port 511 is labelled in FIG. 6. Each connection port 511 includes a respective conductive pin 511*a*. In contrast to the multiport RF connector 210 illustrated in FIGS. 3-5, the ports of the multiport RF connector 510 extend straight through, as opposed to following an L-shaped path. For example, the first row includes port 211*a*, and the second row includes port 212*a*. While the multiport RF connector 210 is illustrated having a total of eight ports, those of ordinary skill in the art will appreciate that, in various implementations, a multiport RF connector includes any number of ports.

Figure 7:
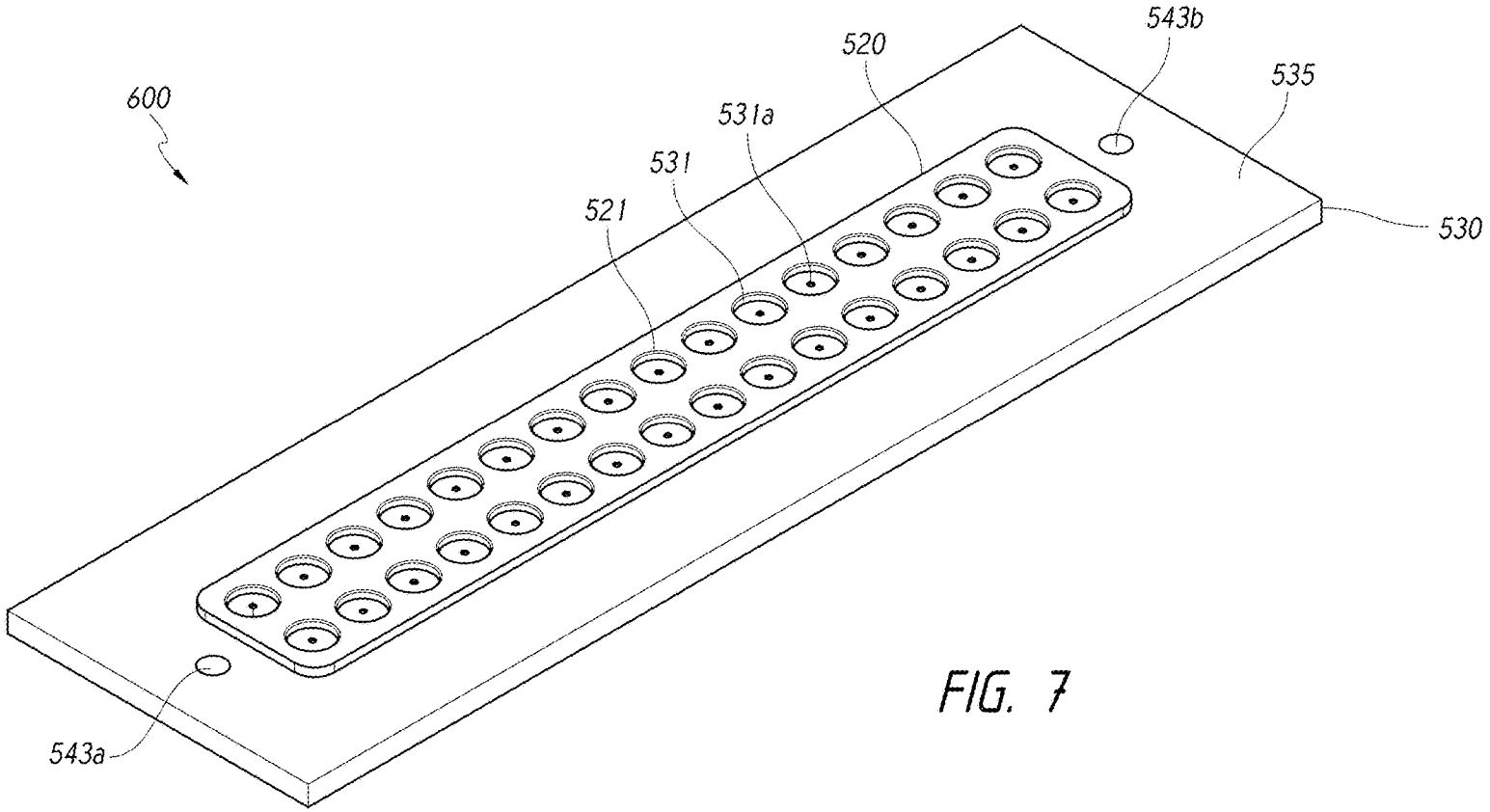
FIG. 7 is a first isolated perspective view of a portion of the multiport connection assembly of FIG. 6.

The metal gasket 520 is arranged between multiport RF connector 510 and the surface 535 of the mounting plate 530. In some implementations, the metal gasket 520 is coupled to electrical ground in order to support EM isolation between ports. With continued reference to FIG. 6, FIG. 7 is a first isolated perspective view of a portion 600 of the multiport connection assembly 500. More specifically, with reference to FIGS. 6 and 7, in some implementations, the metal gasket 520 is one of soldered and epoxied to the surface 535 of the mounting plate 130 and/or the multiport RF connector 510.

Figure 8:
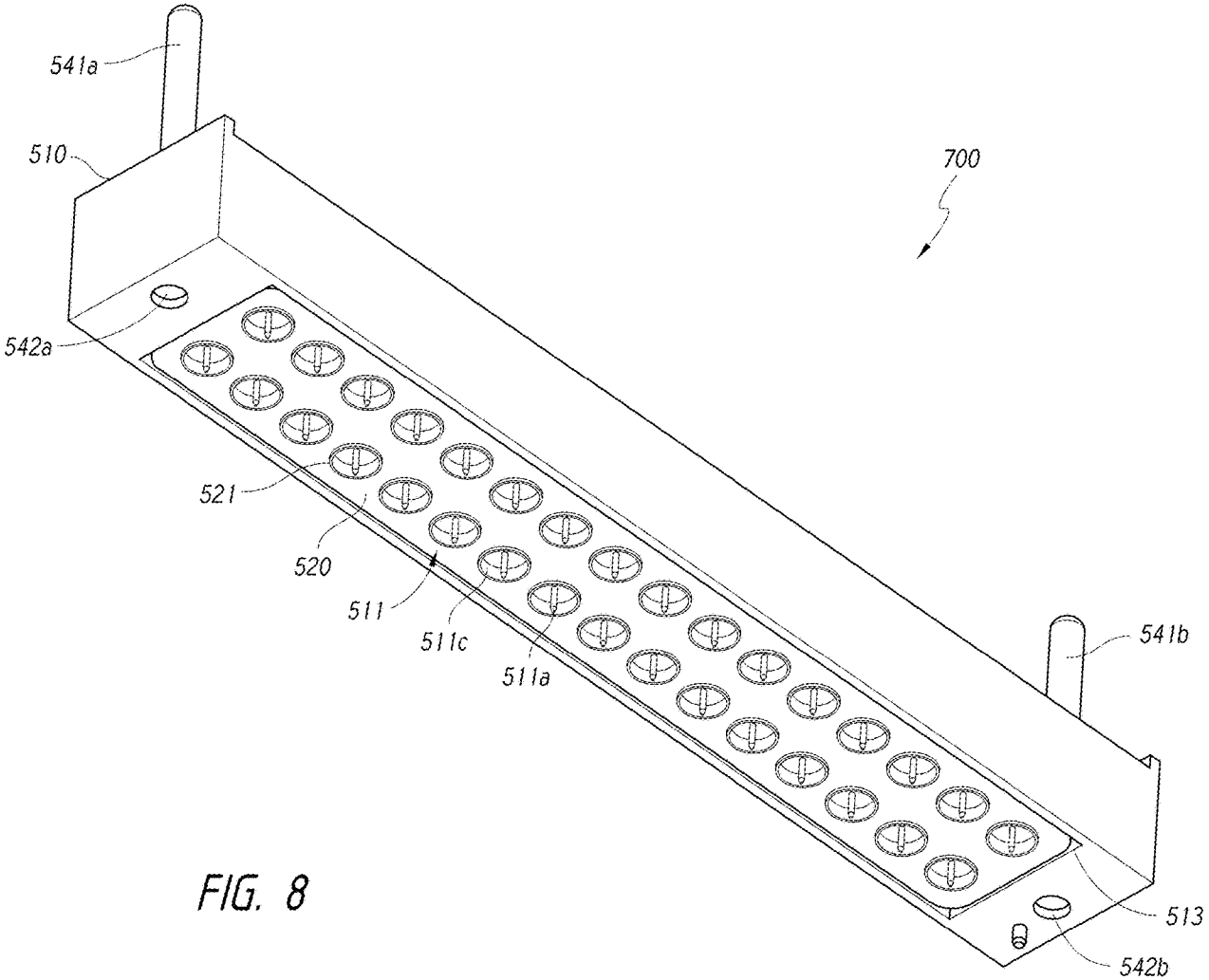
FIG. 8 is a second isolated perspective view of a portion of the multiport connection assembly of FIG. 6.

In some implementations, the metal gasket 520 includes sidewall-defined apertures 521 arranged to enable respective mating of at least some of the connection ports of the multiport RF connector 510 with at least some of the connection ports of the mounting plate 530. In some implementations, the sidewall-defined apertures 521 are sized to mate with port sidewall extensions 511*c* of ports 511 (of the multiport RF connector 510). With continued reference to FIG. 6, FIG. 8 is a second isolated perspective view of another portion 700 of the multiport connection assembly 500. More specifically, FIG. 8 shows the metal gasket 520 fitted into the isolation space defined by the sidewalls 511*c* and the perimeter sidewall 513 of the multiport RF connector 510. Additionally, FIG. 8 also shows that the multiport RF connector 510 includes mounting holes 542*a*, 542*b* provided for optional mechanical fasteners 541*a*, 541*b*.

While various aspects of implementations within the scope of the appended claims are described above, it should be apparent that the various features of implementations described above may be embodied in a wide variety of forms and that any specific structure and/or function described above is merely illustrative. Based on the present disclosure one skilled in the art should appreciate that an aspect described herein may be implemented independently of any other aspects and that two or more of these aspects may be combined in various ways. For example, an apparatus may be implemented and/or a method may be practiced using any number of the aspects set forth herein. In addition, such an apparatus may be implemented and/or such a method may be practiced using other structure and/or functionality in addition to or other than one or more of the aspects set forth herein.

It will also be understood that, although the terms "first," "second," etc. may be used herein to describe various elements, these elements should not be limited by these terms. These terms are only used to distinguish one element from another. For example, a first contact could be termed a second contact, and, similarly, a second contact could be termed a first contact, which changing the meaning of the description, so long as all occurrences of the "first contact" are renamed consistently and all occurrences of the second contact are renamed consistently. The first contact and the second contact are both contacts, but they are not the same contact.

The terminology used herein is for the purpose of describing particular embodiments only and is not intended to be limiting of the claims. As used in the description of the embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting," that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

What is claimed is:

1. An apparatus comprising:

a multiport connector having a first surface, a second surface, a first sidewall extending from the first surface to the second surface and defining a first port, and a second sidewall extending from the first surface to the second surface and defining a second port, wherein the second surface includes an indentation defining an isolation space, wherein at least a portion of the isolation space is between the first sidewall and the second sidewall; and a conductive member at least partially disposed in the portion of the isolation space between the first sidewall and second sidewall.

2. The apparatus of claim 1, wherein the isolation space includes a portion surrounding the first sidewall and the second sidewall and wherein the conductive member is at least partially disposed in the portion of the isolation space surrounding the first sidewall and the second sidewall.

3. The apparatus of claim 1, further comprising a substrate having a first substrate port and a second substrate port.

4. The apparatus of claim 3, wherein the conductive member enables mating of the first port and the first substrate port and enables mating of the second port and the second substrate port.

5. The apparatus of claim 3, wherein the substrate includes at least one of a printed circuit board, a backplane, or a port mounting plate.

6. The apparatus of claim 1, wherein the conductive member is coupled to electrical ground.

7. The apparatus of claim 3, wherein the conductive member is at least one of soldered or epoxied to the substrate.

8. The apparatus of claim 3, further comprising a mechanical fastener provided to support mechanical engagement of the multiport connector with the substrate.

9. The apparatus of claim 8, wherein the mechanical fastener supports mechanical engagement by providing a compressive force below a threshold level characterizing compressive force causing substantial deformation of the substrate.

10. The apparatus of claim 8, wherein the fastener includes at least one of a press-fit tab, a press-fit post, a barb, a screw, a spring, a nail, a staple and a rivet.

11. The apparatus of claim 1, wherein the conductive member is plated with at least one of tin, gold and nickel.

12. The apparatus of claim 1, wherein the conductive member includes an alignment anchor that protrudes in a direction towards the multiport connector, the alignment anchor configured to mate with a respective alignment well of the multiport connector.

13. The apparatus of claim 3, wherein the conductive member includes an alignment anchor that protrudes in a direction towards the substrate, the alignment anchor configured to mate with a respective alignment well of the substrate.

14. The apparatus of claim 1, wherein a majority of the first surface is parallel to a majority of the second surface.

15. The apparatus of claim 1, wherein a majority of the first surface is perpendicular to a majority of the second surface.

16. An apparatus comprising:

a conductive member having a first sidewall defining a first aperture and a second sidewall defining a second aperture; and a multiport connector having a first surface, a second surface, a first sidewall extending from the first surface to the second surface and defining a first port, and a second sidewall extending from the first surface to the second surface and defining a second port, wherein the first port is at least partially disposed within the first aperture and the second port is at least partially disposed within the second aperture.

17. The apparatus of claim 16, further comprising a substrate including a first substrate port and a second substrate port, wherein the conductive member is disposed between the multiport connector and the substrate.

18. The apparatus of claim 17, wherein the conductive member enables mating of the first port and the first substrate port and enables mating of the second port and the second substrate port.

19. The apparatus of claim 16, wherein the conductive member includes an alignment anchor that protrudes in a direction towards the multiport connector, the alignment anchor configured to mate with a respective alignment well of the multiport connector.

20. The apparatus of claim 17, wherein the conductive member includes an alignment anchor that protrudes in a direction towards the substrate, the alignment anchor configured to mate with a respective alignment well of the substrate.

* * * * *